US007374216B2

(12) United States Patent
Rousey et al.

(10) Patent No.: US 7,374,216 B2
(45) Date of Patent: May 20, 2008

(54) LOAD HANDLING APPARATUS AND METHOD

(75) Inventors: Thomas D. Rousey, Atlanta, IL (US); Trent Rousey, Atlanta, IL (US)

(73) Assignee: 3R Products, Inc., Atlanta, IL (US)

( * ) Notice: Subject to any disclaimer, the term of this patent is extended or adjusted under 35 U.S.C. 154(b) by 67 days.

(21) Appl. No.: 11/120,888

(22) Filed: May 3, 2005

(65) Prior Publication Data

US 2006/0249963 A1 Nov. 9, 2006

(51) Int. Cl.
*B25J 1/00* (2006.01)

(52) U.S. Cl. ..... 294/24; 294/19.1

(58) Field of Classification Search ..... 294/19.1, 294/19.2, 19.3, 22, 23, 24; 119/802–805; 43/86, 87

See application file for complete search history.

(56) References Cited

U.S. PATENT DOCUMENTS

| | | | | | |
|---|---|---|---|---|---|
| 959,422 | A | * | 5/1910 | Bechdolt | 119/803 |
| 1,380,891 | A | | 6/1921 | Gaines | |
| 1,850,255 | A | * | 3/1932 | Amble | 119/803 |
| 1,983,425 | A | * | 12/1934 | Willis | 294/103.1 |
| 2,499,511 | A | | 3/1950 | Koger | 119/153 |
| 2,582,339 | A | | 1/1952 | Krueger | 119/153 |
| 3,841,685 | A | | 10/1974 | Kologziej | 294/19 R |
| 3,949,514 | A | * | 4/1976 | Ramsey | 43/87 |
| 4,004,539 | A | | 1/1977 | Wesson | |
| 4,208,827 | A | * | 6/1980 | Starkey | 43/87 |
| 4,547,989 | A | | 10/1985 | Karlsson | 43/5 |
| 4,839,980 | A | * | 6/1989 | Hersom | 43/11 |
| 5,348,359 | A | | 9/1994 | Boozer | |
| 5,487,576 | A | | 1/1996 | DuVivier | 294/19.1 |
| 5,901,994 | A | | 5/1999 | Riddle et al. | 294/19.1 |
| 6,012,416 | A | | 1/2000 | Lammers | 119/804 |
| 6,098,572 | A | | 8/2000 | Cook | 119/802 |
| 6,182,539 | B1 | | 2/2001 | Webster | 81/177.2 |
| 6,293,601 | B1 | | 9/2001 | Johnson | 294/26 |
| 6,409,240 | B1 | | 6/2002 | Ferguson | 294/19.1 |
| 6,485,075 | B1 | | 11/2002 | McClain | 294/19.2 |
| 6,499,778 | B2 | | 12/2002 | Boulay | 294/26 |
| 6,588,065 | B1 | | 7/2003 | Tucker, III | 16/429 |
| 6,602,015 | B1 | | 8/2003 | Evans et al. | 403/109.1 |
| 6,705,654 | B2 | | 3/2004 | Slauf | 294/24 |
| 2004/0084915 | A1 | | 5/2004 | Moffatt | 294/19.1 |

OTHER PUBLICATIONS

International Search Report for PCT/US2006/016893.

* cited by examiner

*Primary Examiner*—Dean J Kramer
(74) *Attorney, Agent, or Firm*—Robert C. Haldiman; Husch Blackwell Sanders

(57) ABSTRACT

A load handling apparatus having a pole, a pushrod, an insert, a tool head, a loop of wire, and a knob is disclosed. The pushrod and insert move within the pole. The tool head is connected to the distal end of the pole. The loop of wire is at least partially disposed within said tool head and connected to the pushrod. The knob is connected to the pushrod and may be rotated to lock the pushrod in place. A user moves the knob to alter the size of the loop of wire.

13 Claims, 6 Drawing Sheets

LOAD HANDLING APPARATUS AND METHOD

CROSS-REFERENCE TO RELATED APPLICATIONS

None.

BACKGROUND OF THE INVENTION

1. Field of the Invention

The present invention is in the field of handling material, loads, cargo and the like within a storage or transportation space, particularly as applied to handling cargo in a truck bed.

2. Related Art

In order to make moving and storing material, loads and cargo efficient, it is most frequently the case that the material is stored and/or transported in a cargo space that is too large for a human being to reach across with only his or her arms. For example, a very common situation is the space of the truck, such as the bed of a pickup truck. There is a continuing need for a tool to ease the manipulation of cargo and items located in truck beds.

Transportation spaces such as truck beds are a particular problem in that the actual transportation often shifts the load within the bed. Therefore, an item that was placed within easy reach, for example just inside the tailgate of a pickup truck, will have moved during transportation to an inaccessible spot, for example against the cab of the truck. Upon arrival then, to unload the cargo from the truck bed, the user must enter the truck bed, push the cargo from the side or pursue other inconvenient approaches to handling the cargo.

The need for a load manipulation tool is further compounded by the great variety of cargo types and load items that are commonly transported by pickup trucks and similar cargo vehicles. A tool that is quickly adapted for one use, for example a hook for a bale of hay, is not useful for manipulating a different load, such as a paint can. Accordingly, there is a need in the art for a handling apparatus that combines a variety of load manipulators in a single device.

Still a further need in the prior art is for a load handling tool that includes a light, because a great deal of pickup truck use occurs at night and in the dark, as for example, by hunters in the field.

SUMMARY OF THE INVENTION

It is in view of the above problems that the present invention was developed. The present invention is a load and material handling apparatus and method. The apparatus includes a pole having a tool head. The tool head has a hook and a loop or snare. The tool head may further include an aperture. The tool head also may include an LED for lighting the cargo to be manipulated. In some embodiments, one or both of the loop or hook may be selectively adjusted in its size, position or extent. In the case of a loop or snare, the size of the snare may be expanded to place over or around an item of cargo and then contracted to draw tight around the cargo. A knob is used to fix the size of the loop or snare after it is adjusted. In at least one embodiment, the pole is extendable, as for example by being telescopic.

The load handling apparatus of the present invention further includes an adjustment for the loop or snare. The adjustment is controlled from the pole which is held in the user's hands. The control is operatively engaged with the loop or snare at the opposite end of the tool head and can be manipulated to expand or contract the snare.

Thus, in furtherance of the above goals and advantages, the present invention is, briefly, a load handling apparatus including a pole having a proximate end portion and a distal end portion, the pole having a slot at its proximate end portion; a pushrod having a first end portion and a second end portion, the pushrod mounted within the pole; a cable connector connected to the first end portion of the pushrod; a tool head connected to the pole at the distal end portion, the tool head having at least one opening; a loop of wire cable operatively connected to the cable connector, wherein at least a portion of the loop is positioned within the at least one opening of the tool head; an insert mounted within the pole and adapted to cover at least a portion of the slot, the insert operatively connected to the pushrod for movement therewith; and a knob operatively connected to the push rod, wherein the slot limits the movement of the knob, and whereby, upon movement of the knob, the pushrod pushes the cable connector such that the loop of wire cable is enlarged.

Further, the present invention is, briefly, a method of assembling a load handling apparatus. The method includes the steps of: providing a pole having a proximate end portion and a distal end portion; cutting a slot within the proximate end portion of the pole; providing a wire cable a first end and a second end; providing a tool head; sliding the first end and the second end through the tool head to form a loop; connecting the loop to a pushrod; placing the pushrod into an insert; placing the insert and the pushrod into the pole; connecting the tool head to the distal end of the pole; and connecting a knob to the pushrod at the slot.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
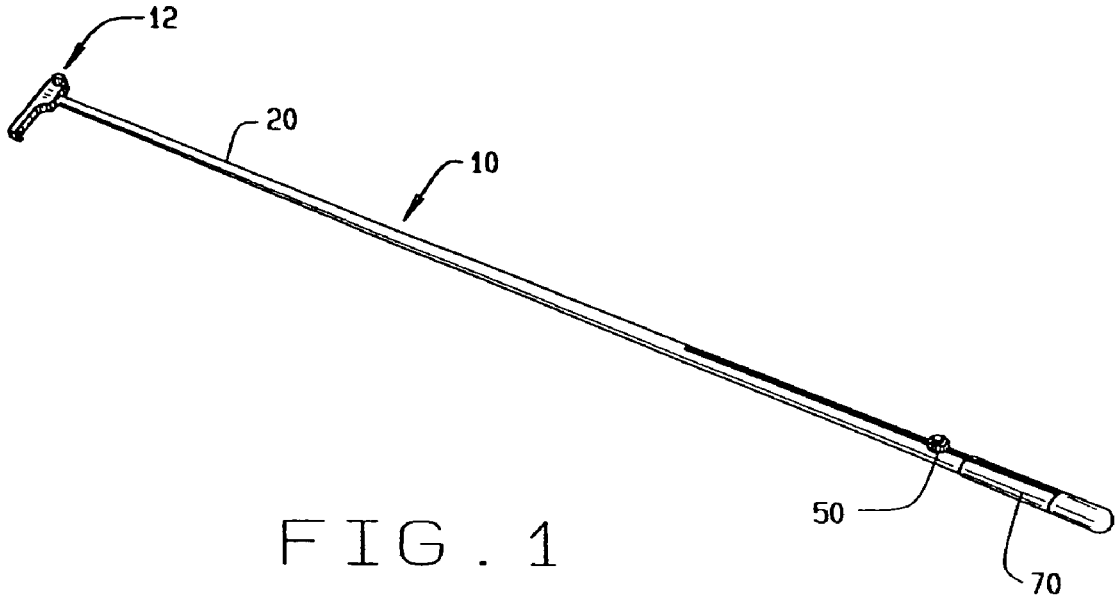
FIG. 1 is a perspective top view of a load handling apparatus.

Referring to the accompanying drawings in which like reference numbers indicate like elements, a load handling apparatus 10, as best seen in FIG. 1, is comprised generally of a tool head 12, a pole 20, a knob 50, and a grip 70.

Figure 2:
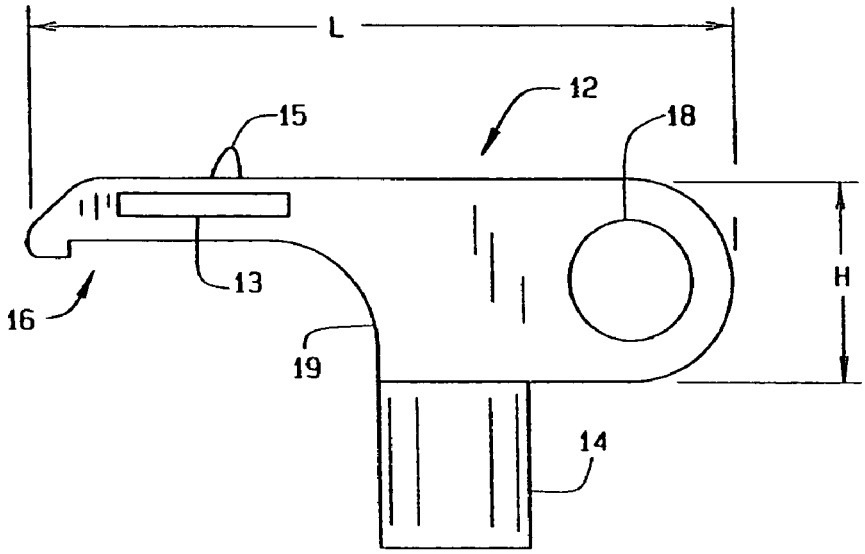
FIG. 2 is a side view of a tool head of the load handling apparatus.

As best seen in FIG. 2, the tool head 12 has a shaft 14, a hooked portion 16, and an aperture 18. The tool head 12 also has a length L and a height H. In the depicted embodiment, the length L is four inches and the height H is 1.25 inches, but other dimensions may be used. The shaft 14 is adapted to fit within an inner diameter of the pole 20. Thus, the shaft 14 is adapted to mate with the pole 20 and is held in place by a friction fit or by fasteners. In the depicted embodiment, the shaft 14 has a diameter of 0.875 inch and frictionally engages the inner diameter of the pole 20. The shaft 14 may be integral with the tool head 12 or it may be a separate component attached by fasteners.

The tool head 12 also includes an aperture 18. The aperture 18 is sized according to the height H of the tool head 12. In the depicted embodiment, the aperture 18 is 0.75 inch. The aperture 18 may be used to mount the load handling apparatus 10 to a wall or some other surface. Additionally, the aperture 18 reduces the overall weight of the load handling apparatus 10.

Figure 4:
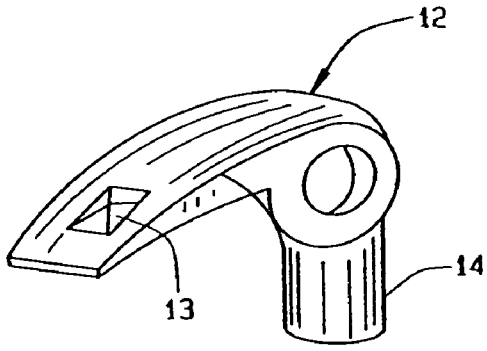
FIG. 4 is a perspective view of the tool head.

As best seen in FIGS. 2 and 4, the tool head 12 may also include or incorporate a magnet 13. In other embodiments, the tool head 12 includes a light source 15, such as a light emitting diode (LED). The light source 15 is powered by a battery stored elsewhere in the apparatus 10. In the depicted embodiments, the tool head 12 is made of aluminum, but other materials may be used.

Figure 3:
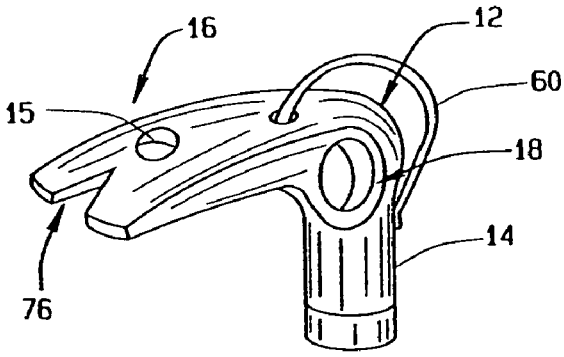
FIG. 3 is a perspective view of the tool head.

The hooked portion 16 may be of any of a variety of configurations. In the embodiment depicted in FIG. 3, the tool head 12 has a slightly curved configuration similar to the claw of a standard carpenter's hammer. Accordingly, the hooked portion 16 may include a notch 76.

Figure 5:
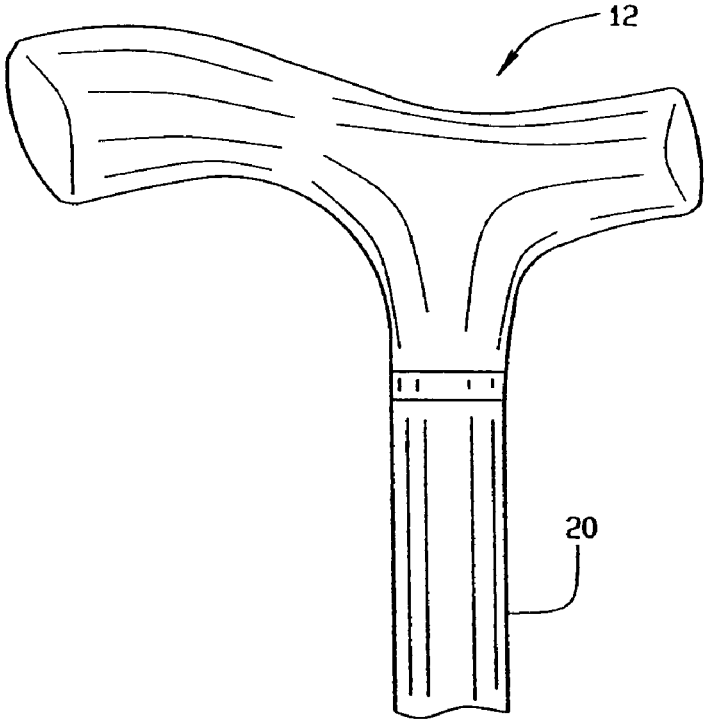
FIG. 5 is a perspective view of an alternative embodiment of the tool head.

In the embodiment depicted in FIG. 5, the tool head 12 has an ergonomic shape that can be readily grasped by a user. As such, the user may use the load handling apparatus 10 as a walking stick or cane.

Figure 6:
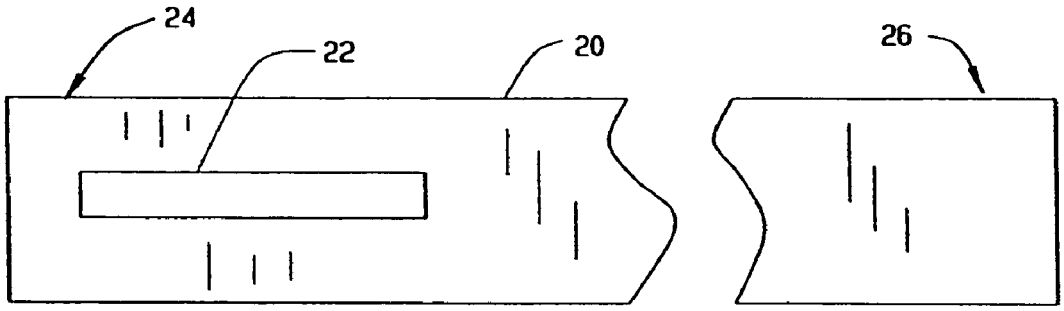
FIG. 6 is a top view of a pole of the load handling apparatus.

The tool head 12 is connected to the pole 20. As an example, a male portion of the tool head 12, such as the shaft 14, may mate with an inner diameter of the pole 20. The pole 20 may be of any various lengths, but preferably is in the range of approximately three feet to approximately six feet. In the depicted embodiment, the pole 20 is approximately four feet long and made from a light weight material, such as aluminum. In the embodiment depicted in FIG. 6, the pole 20 has an outside diameter of about one inch and an inside diameter of about 0.875 inch. The pole 20 has a proximate end portion 24 and a distal end portion 26. The pole 20 includes a slot 22 located in the proximate end portion 24. In the depicted embodiment, the slot 22 is rectangular and is about 0.5 inch wide by about 14 inches in length, but other shapes and sizes may be used. In some embodiments, the pole 20 may be extendible or telescoping.

Figure 7:
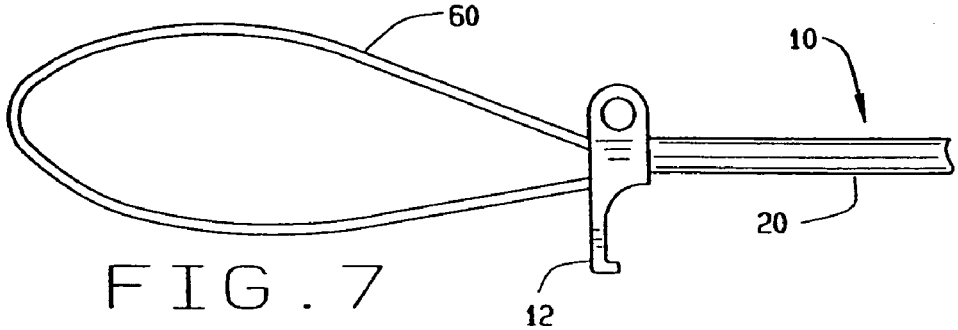
FIG. 7 is a top, partial view of the load handling apparatus.

As best seen in FIG. 7, a loop 60 extends from the tool head 12. The loop 60 is made of a wire cable. In the depicted embodiment, the loop 60 is made of steel and has a wire diameter of 0.125 inch. However, other materials and other wire diameters may be used. The loop 60 extends through the tool head 12 and into the pole 20.

Figure 8:
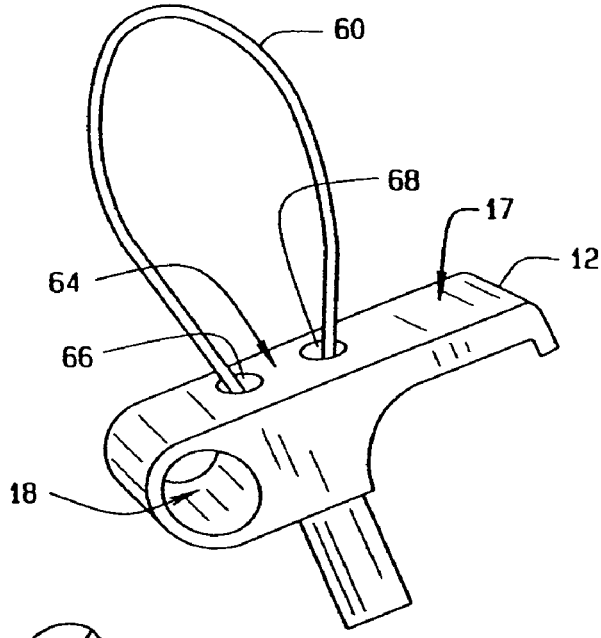
FIG. 8 is a bottom perspective view of the tool head.
Figure 9:
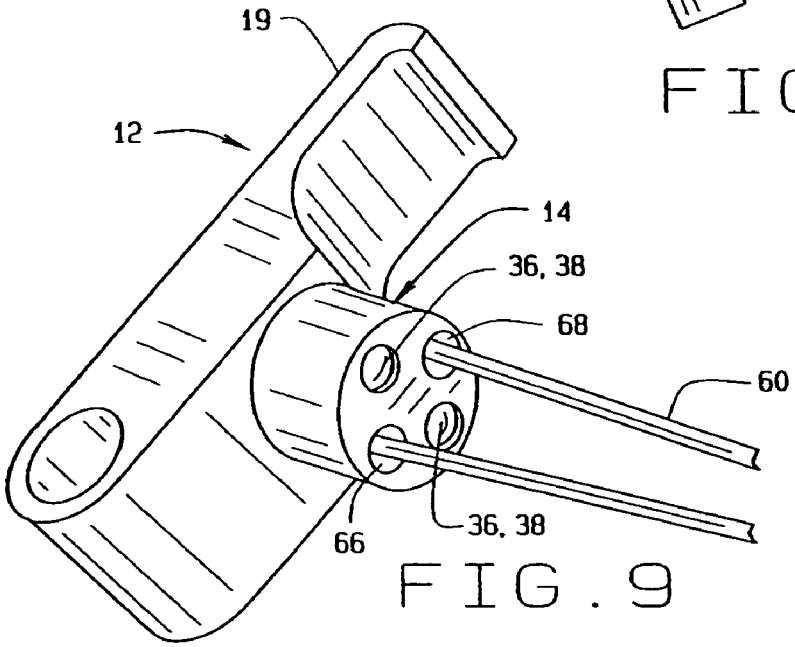
FIG. 9 is a top perspective view of the tool head.

Referring now to FIGS. 8 and 9, the tool head 12 includes a first hole 66 and a second hole 68. The loop 60 extends through the first hole 66 and the second hole 68. In other words, an extendable portion of the loop 60 slides through the through holes 66, 68. When the loop 60 is not in an extended position, much of the loop 60 is stored within the pole 20. The tool head 12 also includes a groove 64. The groove 64 allows the loop 60 to sit below a top surface 17 of the tool head 12. In other words, the groove 64 provides for the complete retraction of the loop 60 into the tool head 12.

The tool head 12 includes screw holes 36 and third fasteners 38. As noted above, in some embodiments the shaft 14 is a separate component from a main body 19 of the tool head 12. For these embodiments, the third fasteners 38 are used to secure the shaft 14 to the main body 19.

Figure 10:
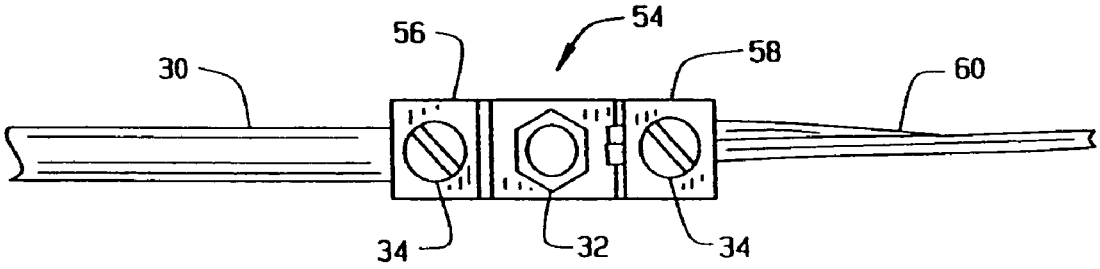
FIG. 10 is a detailed top view of a cable connector in a first embodiment.
Figure 11:
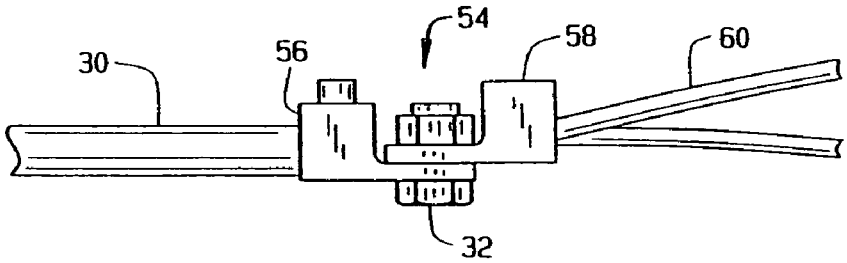
FIG. 11 is a side view of the cable connector shown in FIG. 9.

As best seen in FIGS. 10 and 11, the loop 60 is connected to a pushrod 30. In the depicted embodiments, the loop 60 is connected to the pushrod 30 through the use of a cable connector 54. FIGS. 10 and 11 illustrate a first embodiment of the cable connector 54. In the embodiment depicted in FIGS. 10 and 11, the cable connector 54 includes a first lug 56 and a second lug 58. The first lug 56 is connected to the second lug 58 through the use of a first fastener 32. In the depicted embodiment, the first fastener 32 is a screw with a nut attached to it. Second fasteners 34 are used to connect the pushrod 30 to the first lug 56 and the loop 60 to the second lug 58. In the depicted embodiment, the second fasteners 34 are internal screws that threadingly engage the respective first lug 56 or the second lug 58. The pushrod 30 is inserted into the first lug 56, and the second fastener 34 is screwed into the first lug 56 such that it frictionally engages the pushrod 30. Similarly, end portions of the loop 60 are inserted into the second lug 58, and the second fastener 34 is screwed into the second lug 58 such that it frictionally engages the loop 60.

Figure 12:
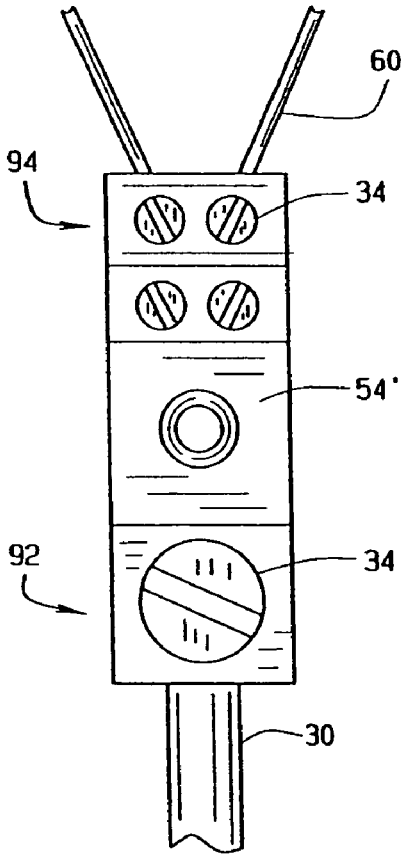
FIG. 12 is a detailed top view of a cable connector in a second embodiment.

FIG. 12 illustrates a second embodiment of the cable connector 54'. In the embodiment depicted in FIG. 12, the cable connector 54' is made of a single component. The cable connector 54' has a first end portion 92 and a second end portion 94. The pushrod 30 is inserted into the first end portion 92 and secured with the second fastener 34. The cable connector 54' has at least two holes located in the second end portion 94 to receive the end portions of the loop 60. The loop ends are inserted into the second end portion 94 and secured with the second fasteners 34.

Figure 13:
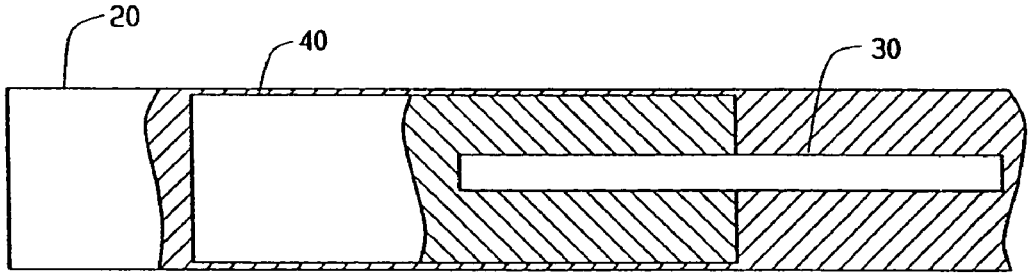
FIG. 13 is a sectional side view of the load handling apparatus.

Referring now to FIG. 13, the pushrod 30, with the loop 60 attached, is located within the pole 20. An insert 40 is placed over the pushrod 30 and within the pole 20. As an example, the insert 40 may be made of plastic. The insert 40 has an outer diameter less than the inner diameter of the pole 20. Thus, the insert 40 can readily slide within the pole 20. As described in greater detail below, the insert 40 moves with the pushrod 30 within the pole 20 and covers at least a portion of the slot 22.

Figure 14:
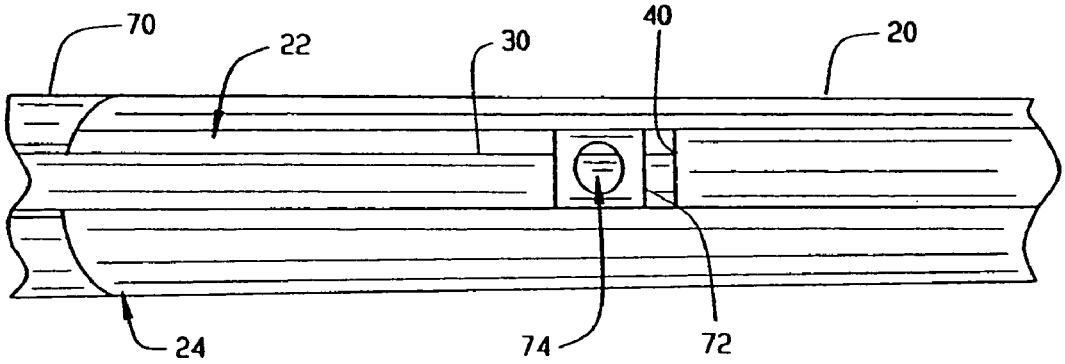
FIG. 14 is a detailed perspective view of the load handling apparatus.

The pushrod 30 is located within the pole 20 and extends to the proximate end portion 24. As an example, the pushrod may be twenty-five inches long and made from steel. The pushrod is aligned with the slot 22 such that it is visible through the slot 22. The insert 40 covers the pushrod 30 and slides within the pole 20. As best seen in FIG. 14, a third lug 72 is connected to the pushrod 30. The insert 40 is captured between the first lug 56 and the third lug 72. Thus, the insert 40 slides with the pushrod 30. The third lug 72 also includes a threaded hole 74.

Figure 15:
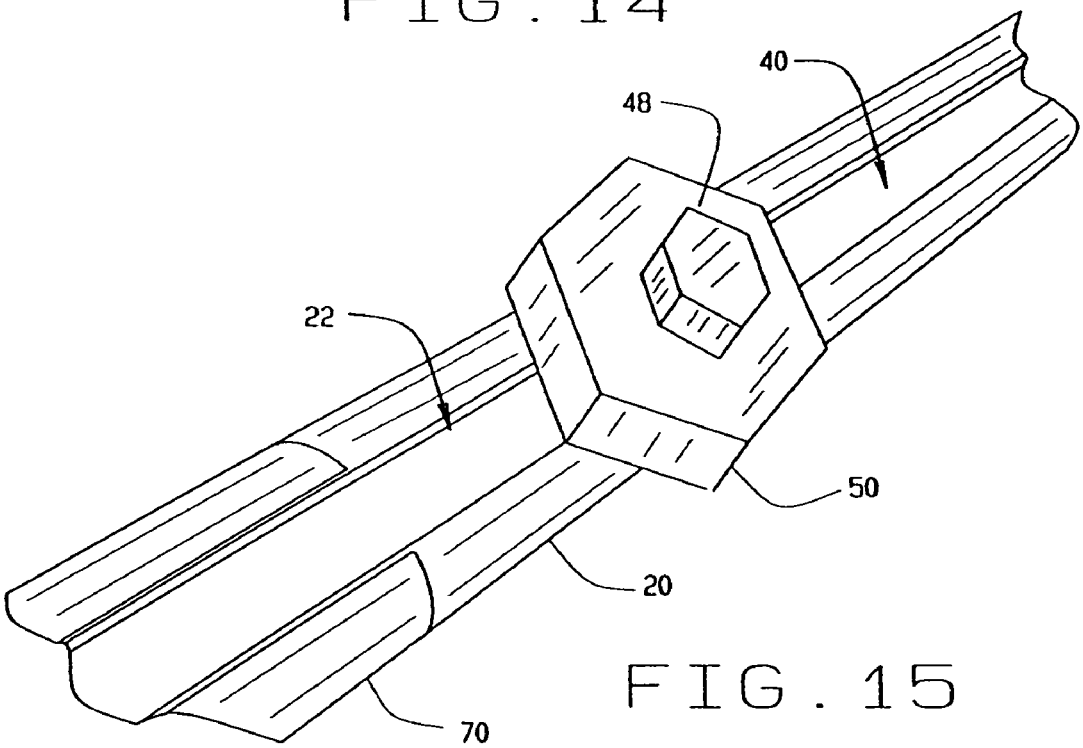
FIG. 15 is a detailed perspective view of the load handling apparatus.

The knob 50 is connected to the pushrod 30. In the embodiment depicted in FIG. 15, the knob 50 is connected to the pushrod 30 via a fourth fastener 48 which engages the threaded hole 74. As an example, the fourth fastener 48 may be a 0.25 inch screw. In the depicted embodiments, the knob 50 has a through hole 46 and the fourth fastener 48 extends though the through hole 46. However, those skilled in the art will understand that other methods of connecting the knob 50 to the pushrod 30 may be used. For example, the knob 50 may have an integral threaded portion that engages the threaded hole 74. The knob 50 may be rotated such that the fourth fastener 48 screws into the threaded hole 74. As the fourth fastener 48 screws into the hole 74, the knob 50 engages the exterior of the pole 20 such that friction between the two surfaces locks the knob 50 in place. Because the pushrod 30 is operatively connected to the knob 50, it also is locked in place.

Figure 16:
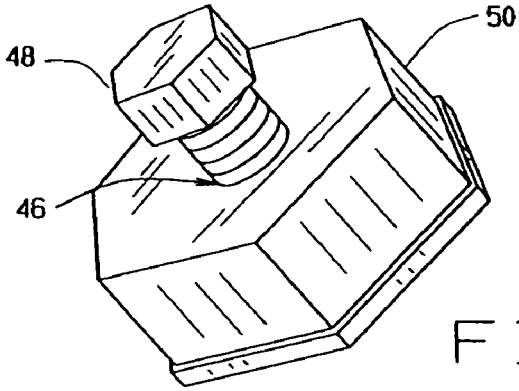
FIG. 16 is a perspective view of a knob.

The knob 50 may any of various configurations and sizes. In the embodiment depicted in FIG. 16, the knob 50 is hex-shaped. However, other shapes may be used. As an example, the knob 50 may be circular. Additionally, the knob 50 may be modified such that it is easier for a user to grip. For example, the knob 50 may be plastic coated or knurled.

A grip 70 covers at least a portion of the proximate end portion 24. The grip 70 may be a plastic handle cover.

Figure 17:
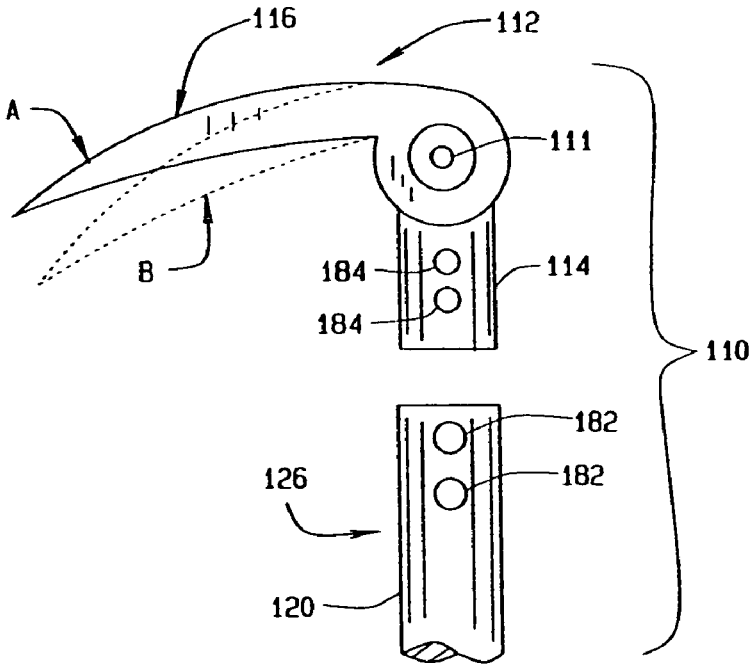
FIG. 17 is an alternative embodiment of the load handling apparatus.

FIG. 17 illustrates an alternative embodiment of the tool load handling apparatus, generally indicated by reference numeral 110. The tool load handling apparatus 110 includes a tool head 112 which mates with a pole 120. Particularly, the tool head 112 includes a shaft 114 that is adapted to fit within an inner diameter of the pole 120. The pole 120 includes locking holes 182, and the shaft 114 includes locking members 184. As an example, the locking members 184 may be through holes. As such, a clevis pin, spring pin, or locking shot pin may be inserted through both the locking holes 182 and the locking members 184 to lock the tool head 112 to the pole 120. Alternatively, the locking members 184 may be spring-loaded buttons that are radially biased such that the locking members 184 positively engage the locking holes 182 when the shaft 114 is inserted into the pole 120.

Additionally, the tool head 112 has a pivotable hooked portion 116 that pivots about a bearing 111, such as an antifriction bearing or a bushing. The hooked portion 116 is pivotable from a first position A to a second position B. The tool head 112 may be incrementally adjusted between positions A and B. Alternatively, the tool head 112 may be infinitely adjustable between positions A and B.

In operation, a user grips the knob 50. The user may rotate the knob 50 to loosen or tighten it. Once the knob 50 is loosened, the user moves the knob 50 along the slot 22 to move the pushrod 30 to contract or enlarge the loop 60. As the pushrod 30 moves, so does the insert 40 such that the insert 40 covers a portion of the slot 22, thereby preventing the user from putting his or her hand into the slot 22. Once the loop 60 is adjusted, the user may once again rotate the knob 50 to lock the pushrod 30 in place. Thereafter, the user can use the loop 60 or the tool head 12 to handle a load. As examples, the user may ensnare the load with the loop 60 or engage the load with the hooked portion 16.

A method of assembling a load handling apparatus is also provided. The method includes the steps of: providing a pole having a proximate end portion and a distal end portion; cutting a slot within the proximate end portion of the pole; providing a wire cable a first end and a second end; providing a tool head; sliding the first end and the second end through the tool head to form a loop; connecting the loop to a pushrod; placing the pushrod into an insert; placing the insert and the pushrod into the pole; connecting the tool head to the distal end of the pole; and connecting a knob to the pushrod at the slot. Optionally, the step of connecting the loop to a pushrod includes the steps of: connecting the pushrod to a cable connector and connecting the loop to the cable connector. Further, the step of connecting a knob to the pushrod at the slot may include the steps of: connecting a lug to the pushrod and connecting the knob to the lug.

As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A load handling apparatus comprising:

a. a pole having a slot, said pole having an inner diameter and an outer diameter, said pole including a proximate end portion and a distal end portion;

b. a pushrod located within said inner diameter of said pole, said pushrod having a first end portion and a second end portion;

c. an insert located within said inner diameter of said pole, said insert operatively connected to said pushrod and adapted to move with said pushrod, said insert covering at least a portion of said slot;

d. a tool head mounted on said distal end portion of said pole;

e. a loop of wire at least partially disposed within said tool head, said loop having a first end portion and a second portion, said first end portion and said second end portion operatively connected to said pushrod;

f. a knob threadingly engaged with said second end portion of said pushrod, wherein said slot limits the movement of said knob, and a user moves said knob to move said pushrod and thereby enlarge said loop, and wherein said knob is rotatable to lock or unlock said pushrod in place.

2. The load handling apparatus according to claim 1, further comprising a grip cover mounted on said proximate end portion of said pole.

3. The load handling apparatus according to claim 1, wherein said slot is rectangular.

4. The load handling apparatus according to claim 1, wherein said tool head further comprises a hooked portion and an aperture.

5. The load handling apparatus according to claim 1, wherein said tool head further comprises a light emitting diode.

6. The load handling apparatus according to claim 1, wherein said tool head has a slightly curved configuration and further comprises a notch.

7. The load handling apparatus according to claim 1, wherein said tool head further comprises a first hole and a second hole, and said loop extends through said first hole and said second hole.

8. The load handling apparatus according to claim 1, wherein said tool head further comprises at least one locking member and said pole includes at least one locking hole.

9. The load handling apparatus according to claim 1, wherein said tool head further comprises a shaft which is adapted to mate with said pole.

10. The load handling apparatus according to claim 9, wherein said shaft is integral with said tool head.

11. A method of assembling a load handling apparatus comprising the steps of:

providing a pole having a proximate end portion and a distal end portion;

cutting a slot within said proximate end portion of said pole;

providing a wire cable a first end and a second end;

providing a tool head;

sliding said first end and said second end through said tool head to form a loop;

connecting said loop to a pushrod;

placing said pushrod into an insert;

placing said insert and said pushrod into said pole;

connecting said tool head to said distal end of said pole; and connecting a knob to said pushrod at said slot.

12. The method of assembling a load handling apparatus according to claim 11, wherein the step of connecting said loop to a pushrod includes the steps of: connecting said pushrod to a cable connector and connecting said loop to said cable connector.

13. The method of assembling a load handling apparatus according to claim 11, wherein the step of connecting a knob to said pushrod at said slot includes the steps of: connecting a lug to said pushrod and connecting said knob to said lug.

* * * * *